US006472857B1

(12) United States Patent
Genest et al.

(10) Patent No.: US 6,472,857 B1
(45) Date of Patent: Oct. 29, 2002

(54) VERY LOW QUIESCENT CURRENT REGULATOR AND METHOD OF USING

(75) Inventors: Pierre Andre Genest, Rouffiac Tolosan; Joel Turchi, Toulouse, both of (FR)

(73) Assignee: Semiconductor Components Industries LLC, Phoenix, AZ (US)

( * ) Notice: Subject to any disclaimer, the term of this patent is extended or adjusted under 35 U.S.C. 154(b) by 0 days.

(21) Appl. No.: 09/842,962

(22) Filed: Apr. 27, 2001

(51) Int. Cl.[7] ..... G05F 5/00; G05F 1/40

(52) U.S. Cl. ..... 323/303; 323/281; 323/274

(58) Field of Search ..... 323/303, 280, 323/281, 274

(56) References Cited

U.S. PATENT DOCUMENTS 4,580,090 A * 4/1986 Bailey et al. ..... 323/303
4,929,882 A * 5/1990 Szepesi ..... 323/222
4,983,905 A * 1/1991 Sano et al. ..... 323/274
5,394,076 A * 2/1995 Huykman ..... 323/222

* cited by examiner

*Primary Examiner*—Bao Q. Vu
(74) *Attorney, Agent, or Firm*—James J. Stipanuk

(57) ABSTRACT

Voltage regulator (10) provides current sense comparator (18) to detect the normal and standby modes of operation for voltage regulator (10). During a normal mode of operation, current sense comparator (18) de-asserts signal (MODE), causing voltage regulator (10) to regulate the output voltage to a predetermined level. Once the current ($I_{in}$) has diminished below a predetermined value, current sense comparator (18) asserts signal (MODE) to indicate a standby mode. During the standby mode, regulator (10) regulates the output voltage ($V_{out}$) between first and second reference levels, requiring a quiescent current level much less than the quiescent current level required during normal mode, due to the deactivation of current sense comparator (18) and error amplifier (28) during standby mode. An alternate method of quiescent current reduction uses switched voltage reference (86). Bandgap reference (80) supplies voltage reference ($V_{ref1}$) during normal mode of operation and depletion MOS reference supplies voltage reference ($V_{ref1}$) during standby mode of operation.

5 Claims, 4 Drawing Sheets

VERY LOW QUIESCENT CURRENT REGULATOR AND METHOD OF USING

BACKGROUND OF THE INVENTION

The present invention relates in general to voltage regulators and, more particularly, to voltage regulators requiring very little quiescent current in a standby mode of operation.

Electronic devices such as Global System for Mobile Communications (GSM) cellular telephones and laptop computers generally require operational power in two separate modes of operation. A first mode of operation is provided such that the regulator is supplied enough quiescent current to allow sufficient noise immunity, Power Supply Rejection Ratio (PSRR) and dynamic performance, for example, requiring maximum quiescent current. A second mode of operation is characterized as a standby mode of operation, where the regulator supplies a coarsely regulated potential without the high performance specification requirements of the first mode. A fraction of the quiescent current, therefore, is needed in standby mode, to maintain only critical components required to detect a transition from standby mode into the fully operational mode at the desired time. The provisioning of two separate modes of operation, allows the electronic device to conserve energy during the standby mode of operation.

Prior art voltage regulators provide four main components. First, an error amplifier that generates an error voltage between the actual output voltage and the desired output voltage. Second, an internal voltage reference that generates a reference voltage, typically with a bandgap reference, which is used by the error amplifier to generate the error voltage. Third, a pass transistor, typically p-type, used to operate in linear mode, controlling the amount of current delivered to the load. Fourth, a buffer used to buffer the control input of the pass transistor from the output of the error amplifier.

Prior art voltage regulators employ error amplifiers designed to exhibit proper performance during nominal, or full function, operation. Full function operation of the prior art error amplifier requires enough quiescent current such that the error amplifier, for example, provides proper noise immunity while providing the specified dynamic performance. Typical quiescent current required by prior art regulators is approximately 30 micro-amps(uA) during full function operation. Prior art regulators, however, do not employ dual mode operation, whereby an idle or standby mode is detected with a subsequent reduction in power consumption during the idle or standby mode.

Hence, there is a need for a voltage regulator providing the ability to detect the standby operational mode and further implementing a reduction in power consumption while operating in the standby mode.

DETAILED DESCRIPTION OF THE DRAWINGS

Figure 1:
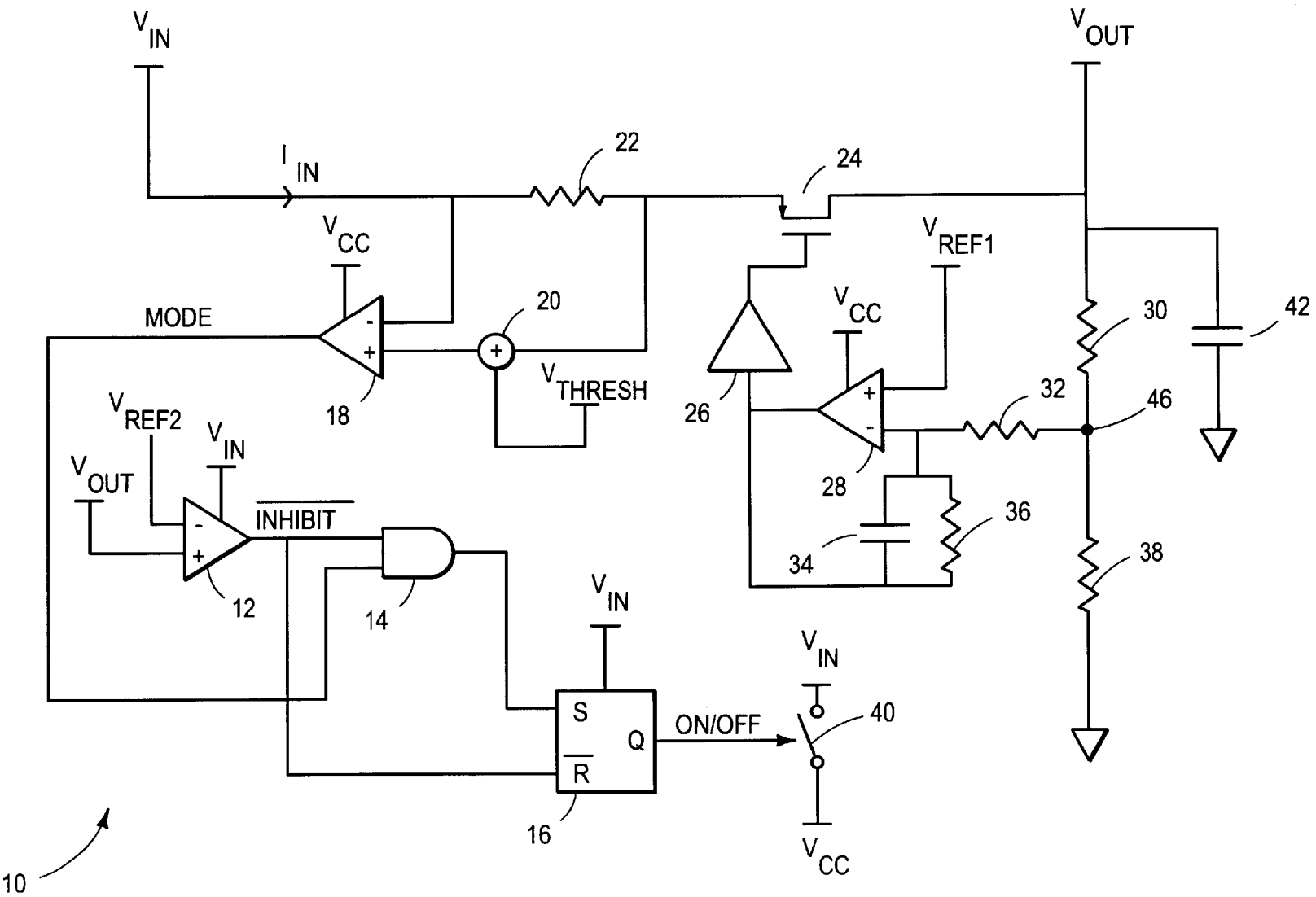
FIG. 1 is a schematic diagram illustrating a voltage regulator operational in standby and full function modes.

In FIG. 1, a schematic diagram of voltage regulator 10 is illustrated. A current path exists between node $V_{in}$ and node $V_{out}$ through resistor 22 and pass transistor 24, used to deliver supply current to a load connected to node $V_{out}$ (not shown). Pass transistor 24 is typically a p-type device. A first conductor of resistor 30 is coupled to a first conductor of transistor 24, terminal $V_{out}$, and a first terminal of capacitor 42. A second conductor of capacitor 42 is coupled to a second supply potential, for example, ground potential. A second conductor of resistor 30 is coupled to a first conductor of resistor 38 and a first conductor of resistor 32 at node 46. A second conductor of resistor 38 is coupled to a second power supply, for example, ground potential. The inverting input of error amplifier 28 is coupled to a second conductor of resistor 32. The non-inverting input to error amplifier 28 is coupled to voltage reference $V_{ref1}$. Error amplifier 28 derives operational supply voltage from terminal $V_{cc}$. The output of error amplifier 28 is coupled to a first conductor of resistor 36, a first conductor of capacitor 34 and to the input to buffer 26. Second conductors of resistor 36 and capacitor 34 are coupled to the inverting input of error amplifier 28. The output of buffer 26 is coupled to the control terminal of pass transistor 24. The inverting input of comparator 18 is coupled to node $V_{in}$ and to a first conductor of resistor 22. It should be noted that although a direct connection from the inverting input of comparator 18 to the $V_{in}$ terminal is illustrated in FIG. 1, only a portion of $V_{in}$, perhaps through a voltage divider (not shown) for example, is taken at the inverting input to comparator 18. An equivalent voltage divider (not shown) for the non-inverting input to comparator 18 is also used. A first conductor of summer 20 is coupled to a second conductor of resistor 22 and a first conductor of transistor 24. A second conductor of summer 20 is coupled to $V_{thresh}$. The output terminal of summer 20 is coupled to the non-inverting input to current sense comparator 18. The output of current sense comparator 18 is coupled to a second input of AND gate 14. Current sense comparator 18 receives operating supply potential from terminal $V_{cc}$. Hysteretic comparator 12 receives $V_{out}$ and $V_{ref2}$ at the non-inverting and inverting inputs of comparator 12, respectively. The output of comparator 12 is coupled to a first input of AND gate 14. Comparator 12 receives operating potential from terminal $V_{in}$. The output of AND gate 14 is coupled to the set input of SR flip flop 16. The reset input of SR flip flop 16 is coupled to the output of comparator 12. The Q output of SR flip flop 16 provides signal ON/OFF to the control terminal of switch 40. Switch 40 is coupled to terminal $V_{in}$ at a first conductor and to terminal $V_{cc}$ at a second conductor.

In operation, voltage regulator 10 controls pass transistor 24 to supply a current to a load connected to terminal $V_{out}$ (not shown) during a full function mode of operation. A full function mode of operation is defined to be the mode of operation where switch 40 is closed, thereby supplying operational power to comparator 18 and error amplifier 28 via the $V_{cc}$ terminal. Full function mode may also include other auxiliary functions, such as over-current protection circuitry (not shown), which receives operational power from the $V_{cc}$ terminal. Regulator 10 requires, for example, 100 micro-amps (uA) of quiescent current during full function mode of operation. A second mode of operation, or standby mode, is defined to be the mode of operation whereby switch 40 is open, thereby disabling comparator 18 and error amplifier 28, and other auxiliary components (not shown), by removing the operating supply potential $V_{cc}$ from the respective operating supply potential inputs of comparator 18 and error amplifier 28 and other auxiliary components (not shown). Standby mode, therefore, provides operational power only to comparator 12, AND gate 14 and SR flip flop 16 through terminal $V_{in}$. Standby mode quiescent current, for example, is approximately 1 uA. Standby mode is detected through the use of AND gate 14, SR flip flop 16 and current sense comparator 18 as discussed hereinafter.

Voltage regulator 10 is a linear mode voltage regulation circuit, regulating voltage at terminal $V_{out}$ to a potential lower than $V_{in}$. $V_{in}$, for example, ranges from 3 to 6 volts and $V_{out}$ is, for example, regulated between 1.8 to 2.8 volts. The conduction state of transistor 24 is controlled by the output of buffer 26. As the output voltage of buffer 26 reduces, transistor 24 increases conductivity, which allows an increased amount of current to flow into capacitor 42, increasing the magnitude of $V_{out}$. As the magnitude of $V_{out}$ varies, the magnitude of the voltage at node 46 also varies according to the voltage divider ratio established by resistors 30 and 38. The voltage at node 46 is compared to the reference voltage $V_{ref1}$ and the difference between the voltage at node 46 and $V_{ref1}$ is amplified by error amplifier 28 according to the gain established by the ratio of resistor 36 to resistor 32 and the stability of the control loop is established by capacitor 34, which sets a first order pole in the transfer function of the voltage control loop. The voltage control loop being established by the divided output voltage feedback from node 46, through error amplifier 28, through buffer 26 and finally into the control terminal of transistor 24. Buffer 26 is an inverting buffer, such that increasing voltage at the input to buffer 26 results in decreasing voltage at the output of buffer 26. Conversely, decreasing voltage at the input to buffer 26 results in increasing voltage at the output of buffer 26.

Capacitor 42 receives charge current, $I_{in}$, from terminal $V_{in}$, via sense resistor 22 and pass transistor 24. Accordingly, the voltage present at terminal $V_{out}$ increases due to the accumulation of charge across capacitor 42. The voltage at node 46, $V_{46}$, varies in proportion to the voltage at terminal $V_{out}$ according to the following equation: $V_{46}=V_{out}*R_{38}/(R_{38}+R_{30})$, where $R_{38}$ is the resistance of resistor 38 and $R_{30}$ is the resistance of resistor 30. Error amplifier 28 receives the proportionally increased voltage, $V_{46}$, at the inverting input and compares the proportionally increased voltage to the reference voltage, $V_{ref1}$, present at the non-inverting input. If the voltage at the inverting input of error amplifier 28 is greater than $V_{ref1}$, error amplifier 28 compensates by decreasing the output voltage of error amplifier 28. The decreasing output voltage of error amplifier 28 is buffered and inverted by buffer 26, such that the voltage at the control terminal of transistor 24 increases. Since transistor 24 is p-type, the conductivity of transistor 24 reduces, decreasing the amount of current supplied to capacitor 42, thereby reducing $V_{out}$. If, on the other hand, the voltage at the inverting input of error amplifier 28 is less than $V_{ref1}$, indicating a falling voltage at terminal $V_{out}$, error amplifier 28 compensates by increasing the output voltage of error amplifier 28. The increasing output voltage of error amplifier 28 is buffered and inverted by buffer 26, such that the voltage at the control terminal of transistor 24 decreases. Since transistor 24 is p-type, the conductivity of transistor 24 increases, increasing the amount of current supplied to capacitor 42, thereby increasing $V_{out}$. It can be seen, therefore, that the voltage control loop serves to linearly regulate the voltage at terminal $V_{out}$ to a voltage substantially equal to $$V_{out}=V_{ref1}(1+R_{30}/R_{38}) \quad (1)$$

during a normal mode of operation.

Sense resistor 22, in combination with current sense comparator 18 and summer 20, provide a current sensing function for regulator 10. As current $I_{in}$ flows through sense resistor 22, a potential develops across resistor 22. Current sense comparator 18 performs a voltage subtraction of voltages present at the inputs to current sense comparator 18. The voltage present at the inverting input, $V_{inv}$, of current sense comparator 18 is given by $V_{inv}=V_{in}$. The voltage present at the non-inverting input, $V_{non-inv}$, of current sense comparator 18 is given by $V_{non-inv}=V_{in}-V_{22}+V_{thresh}$, where $V_{22}$ is the voltage developed across sense resistor 22 by current $I_{in}$. Subtracting $V_{inv}$ from $V_{non-inv}$, to produce $V_{diff}$, $V_{diff}=V_{non-inv}-V_{inv}=V_{thresh}-V_{22}$. It can be seen, therefore, that if $V_{diff}$ is positive, $V_{thresh}$ is larger than $V_{22}$, indicating that $I_{in}$ is below the full function current threshold, $I_{thresh}$. When $I_{in}$, is below the full function threshold, $I_{thresh}$, signal MODE asserts to a logic high indicating standby mode. Conversely, if $V_{diff}$ is negative, $V_{22}$ is larger than $V_{thresh}$, indicating that $I_{in}$ is above the full function current threshold, $I_{thresh}$. When $I_{in}$ is above the full function current threshold, $I_{thresh}$, signal MODE de-asserts to a logic low indicating normal mode. It should be noted that other current sense circuits, such as current mirrors, can be used as an alternate current detection means. In addition, normal and standby modes may also be detected by using the output voltage of error amplifier 28. The output voltage of error amplifier 28 is monitored by a second comparator (not shown). If the error voltage is below a predetermined threshold, for example, the second comparator's output indicates that the current drive of regulator 10 is low and, therefore, standby mode is indicated. Conversely, if the error voltage is above the predetermined threshold, for example, the second comparator's output indicates that the current drive of regulator 10 is high and, therefore, normal mode is indicated.

AND gate 14 and hysteretic comparator 12 combine to form a gating circuit for signal MODE. A logic high output from comparator 12 serves to allow AND gate 14 to pass the MODE signal to the set input of SR flip flop 16 and a logic low output from comparator 12 serves to block the MODE signal from the set input of SR flip flop 16. Comparator 12 is a hysteretic comparator such that the comparator output triggers at different applied voltage levels depending upon the slope of the voltage applied at the input to comparator 12. A positive sloped voltage for $V_{out}$ at the non-inverting input to comparator 12, for example, causes a logic high output when $V_{out}$ exceeds a first voltage threshold level, $V_{thresh1}$, which is above $V_{ref2}$. Conversely, a negative sloped voltage for $V_{out}$ causes a logic low output when $V_{out}$ is less than a second threshold level, $V_{thresh2}$, which is below $V_{ref2}$. The magnitude of $V_{thresh2}$ being less than the magnitude of $V_{thresh1}$. SR flip flop 16 receives the output of AND gate 14 at the S input and asserts signal ON/OFF to a logic high level when the S input transitions from a logic low to a logic high level. The R input of SR flip flop 16 receives the output of comparator 12 and causes the Q output to reset to a logic low level, de-asserting signal ON/OFF, when the output of comparator 12 transitions from a logic high level to a logic low level. Switch 40 operates in response to the ON/OFF signal. Switch 40 is open, disconnecting $V_{in}$ from $V_{cc}$, when signal ON/OFF is at a logic high level and switch 40 is closed, connecting $V_{in}$ to $V_{cc}$, when signal ON/OFF is at a logic low level. Error amplifier 28 and current sense comparator 18 are shown to be inhibited during a non-charging phase of the standby mode by removing the supply potential, $V_{in}$, from the $V_{cc}$ terminal, through the operation of a voltage control circuit comprising hysteretic comparator 12, AND gate 14 SR flip flop 16 and switch 40. It should be noted that SR flip flop 16 is reset dominant, such that the simultaneous occurrence of the set and reset signals results in the reset of SR flip flop 16. Alternate methods may be used to disable functional blocks during the standby mode. Systems utilizing internal current sources to provide operational power to functional blocks, for example, are inhibited by controlling the internal current sources using signal ON/OFF, as opposed to, enabling and disabling the $V_{cc}$ supply voltage using signal ON/OFF, as discussed above.

Figure 1A:
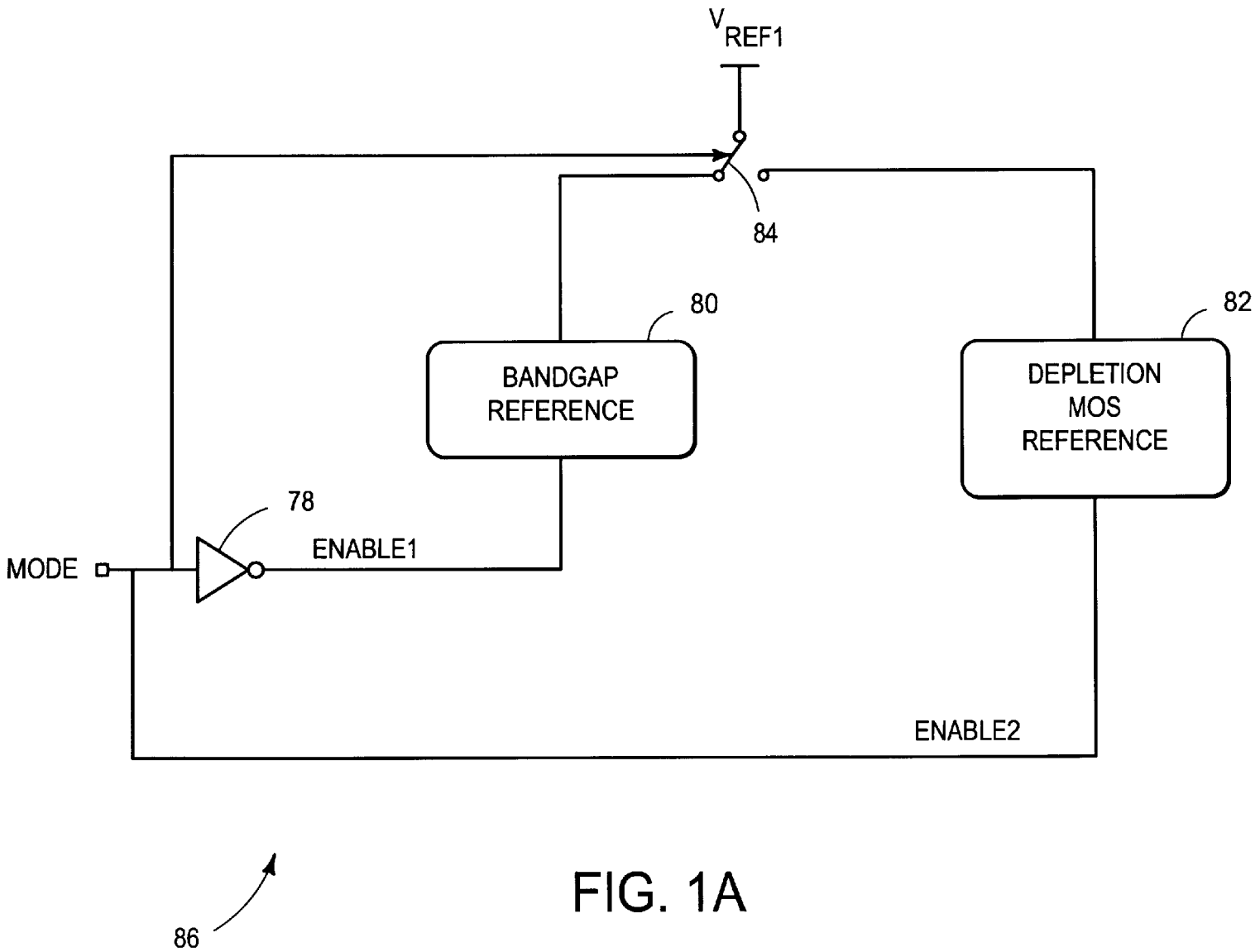
FIG. 1A is a schematic of switchable reference voltages optionally used by the voltage regulator of FIG. 1.

An alternate method of reducing quiescent current during a standby mode of operation is implemented through the use of switched voltage reference 86, as shown in FIG. 1A. Signal MODE is received by inverter 78, the control terminal of switch 84 and the ENABLE2 terminal of depletion Metal Oxide Semiconductor (MOS) reference 82. The output voltage of bandgap reference 80 and depletion MOS reference 82 is supplied to first and second conductors of switch 84, respectively. Under normal operating conditions, signal MODE is at a logic low level. Bandgap reference 80 is enabled, since signal ENABLE1 is at a logic high level due to the operation of inverter 78. The position of switch 84 is as shown in FIG. 1A, such that bandgap reference 80 supplies potential $V_{ref1}$ during the normal mode of operation. Under standby mode of operation, during a non-charging phase of regulator 10, signal MODE is at a logic high level, setting signal ENABLE2 to a logic high level. Since ENABLE2 is at a logic high level, depletion MOS reference 82 is enabled and switch 84 is selecting the output of depletion MOS reference 82 to supply $V_{ref1}$. Selecting between two reference generation circuits as shown in FIG. 1A, results in a quiescent current reduction during standby mode of, for example, a factor of 25. In other words, normal mode operation results in a quiescent current drain of 100 uA, for example, using bandgap reference 80 and a 4 uA drain, for example, using depletion MOS reference 82. It should be noted that use of switched references as shown in FIG. 1A, allows error amplifier 28 and hysteretic comparator 18 to remain connected to $V_{in}$ during standby mode. In other words, all components of voltage regulator 10 remain active while in standby mode and the quiescent current reduction is obtained entirely through the use of voltage reference 86. It should be noted that implementation of switched voltage reference 86 precludes the use of hysteretic comparator 12, AND gate 12, SR flip flop 16 and switch 40, which are components required to disconnect $V_{cc}$ from terminal $V_{in}$. Implementation of switched voltage reference 86, in other words, allows regulator 10 to function at a reduced quiescent current while allowing all components of regulator 10 to be operative, through the use of a low power voltage reference, such as depletion MOS reference 82.

Figure 2:
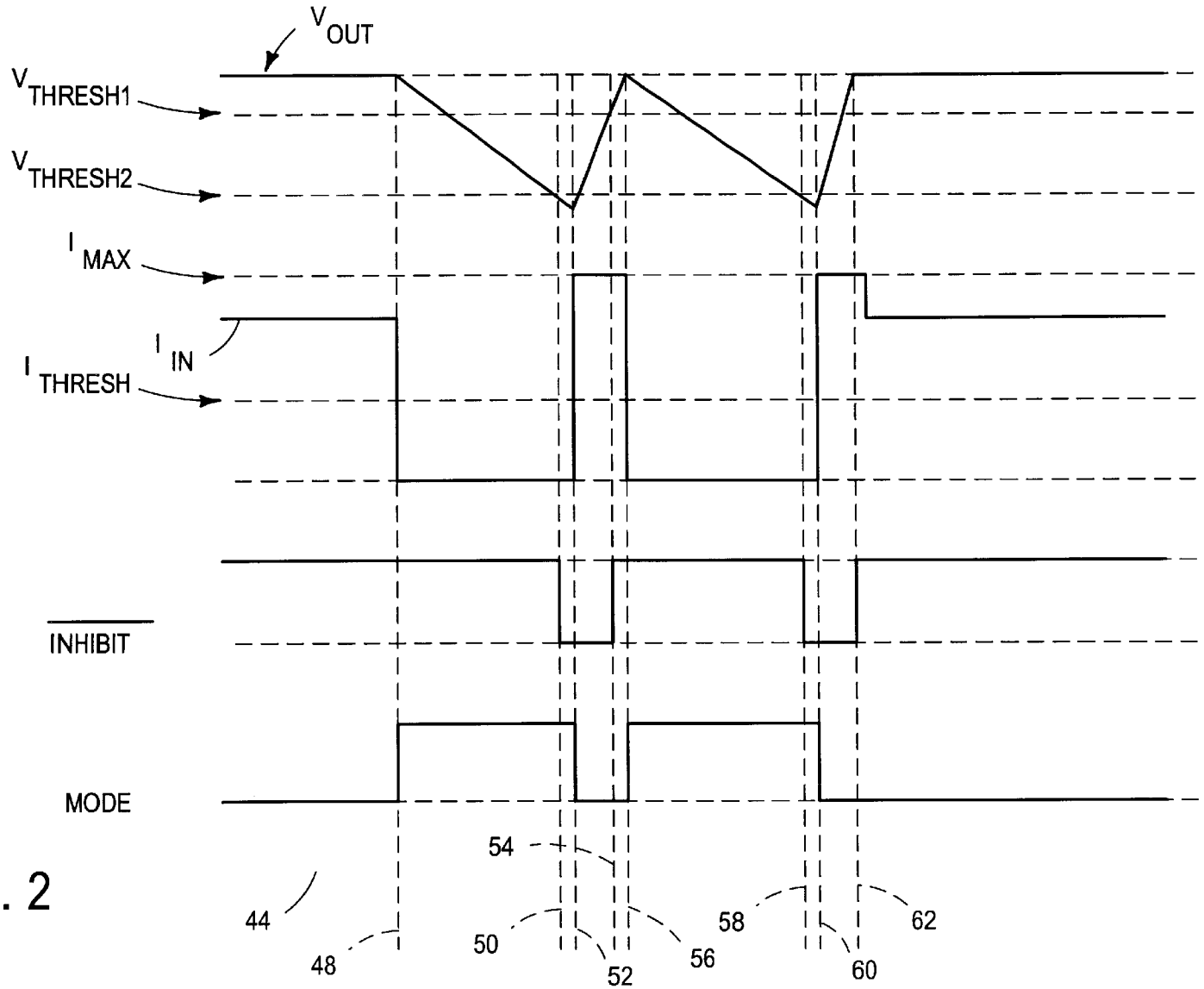
FIG. 2 is a waveform plot useful in explaining the operation of the voltage regulator of FIG. 1.

FIG. 2 displays a waveform plot illustrating the operation of voltage regulator 10. At time 44, voltage regulator 10 is in full function, or normal mode. $V_{out}$ is fully regulated according to equation (1) and $I_{in}$, is at a level above $I_{thresh}$. At time 48, $I_{in}$ decreases as the load connected to terminal $V_{out}$ (not shown) is diminished. Once $I_{in}$ passes through $I_{thresh}$, the voltage across sense resistor 22 reduces below $V_{thresh}$, causing signal MODE to assert to a logic high. Since $V_{out}$ exceeds $V_{thresh1}$ at time 48, signal $\overline{\text{INHIBIT}}$ is at a logic high and the output of AND gate 14 sets SR flip flop 16. Setting SR flip flop 16 causes signal ON/OFF to assert to a logic high, disabling switch 40. Once disabled, switch 40 disconnects $V_{in}$ from terminal $V_{cc}$, causing current sense comparator 18 and error amplifier 28 to turn off. Regulator 10, therefore, enters into a standby mode of operation beginning at time 48. Error amplifier 28 is non-functional, since terminal $V_{cc}$ is disconnected from terminal $V_{in}$. Pass transistor 24 is no longer conductive, allowing the voltage across capacitor 42 to diminish, due to the action of the load connected to terminal $V_{out}$ (not shown) discharging capacitor 42. $V_{out}$ diminishes to a voltage equal to $V_{thresh2}$ at time 50, triggering hysteretic comparator 12 to assert signal $\overline{\text{INHIBIT}}$ to a logic low value. The logic high to logic low transition of signal $\overline{\text{INHIBIT}}$ at the R input of SR flip flop 16 causes the ON/OFF signal to reset to a logic low, enabling switch 40 to the closed position, coupling terminal $V_{in}$ to terminal $V_{cc}$. Time 52, therefore, marks the beginning of a charging phase, within the standby mode, whereby voltage regulator 10 engages pass transistor 24 to supply current to capacitor 42. As current $I_{in}$ increases above $I_{thresh}$ to $I_{max}$ shortly after time 52, signal MODE transitions to a logic low value. At time 54, $V_{out}$ has increased to the value of $V_{thresh1}$, which causes signal $\overline{\text{INHIBIT}}$ to transition from a logic low to a logic high value. Voltage $V_{out}$ continues to increase, since error amplifier 28 is driving the output voltage $V_{out}$ to be substantially according to equation (1). Once output voltage $V_{out}$ reaches the regulated value defined by equation (1), current $I_{in}$ decreases and transitions signal MODE from a logic low to a logic high after current $I_{in}$ decreases below $I_{thresh}$, at time 56. Since signal $\overline{\text{INHIBIT}}$ is at a logic high value, the transition of signal MODE at time 56 causes AND gate 14 to provide a logic low to a logic high transition to the S input of SR flip flop 16. The Q output of SR flip flop 16 transitions from a logic low to a logic high value causing signal ON/OFF to transition to a logic high value, disabling switch 40, thereby decoupling terminal $V_{in}$ from terminal $V_{cc}$, which ends the charging cycle within the standby mode. Beginning at time 60, for example, the load coupled to terminal $V_{out}$ (not shown) increases to full load, causing $I_{in}$, to increase. Signal MODE de-asserts to a logic low value at time 60, followed by a logic low to logic high transition of signal $\overline{\text{INHIBIT}}$, at time 62, once $V_{out}$ exceeds $V_{thresh1}$. Normal voltage regulation resumes and full function, or normal operation, begins once again. It can be seen therefore, that regulator 10 provides a dual function voltage regulator. At normal loading conditions, regulator 10 employs full function voltage regulation, requiring, for example, 100 uA of quiescent current for operation. At below normal loading conditions, regulator 10 employs a reduced function voltage regulation, requiring, for example, 1 uA of quiescent current for operation.

Figure 3:
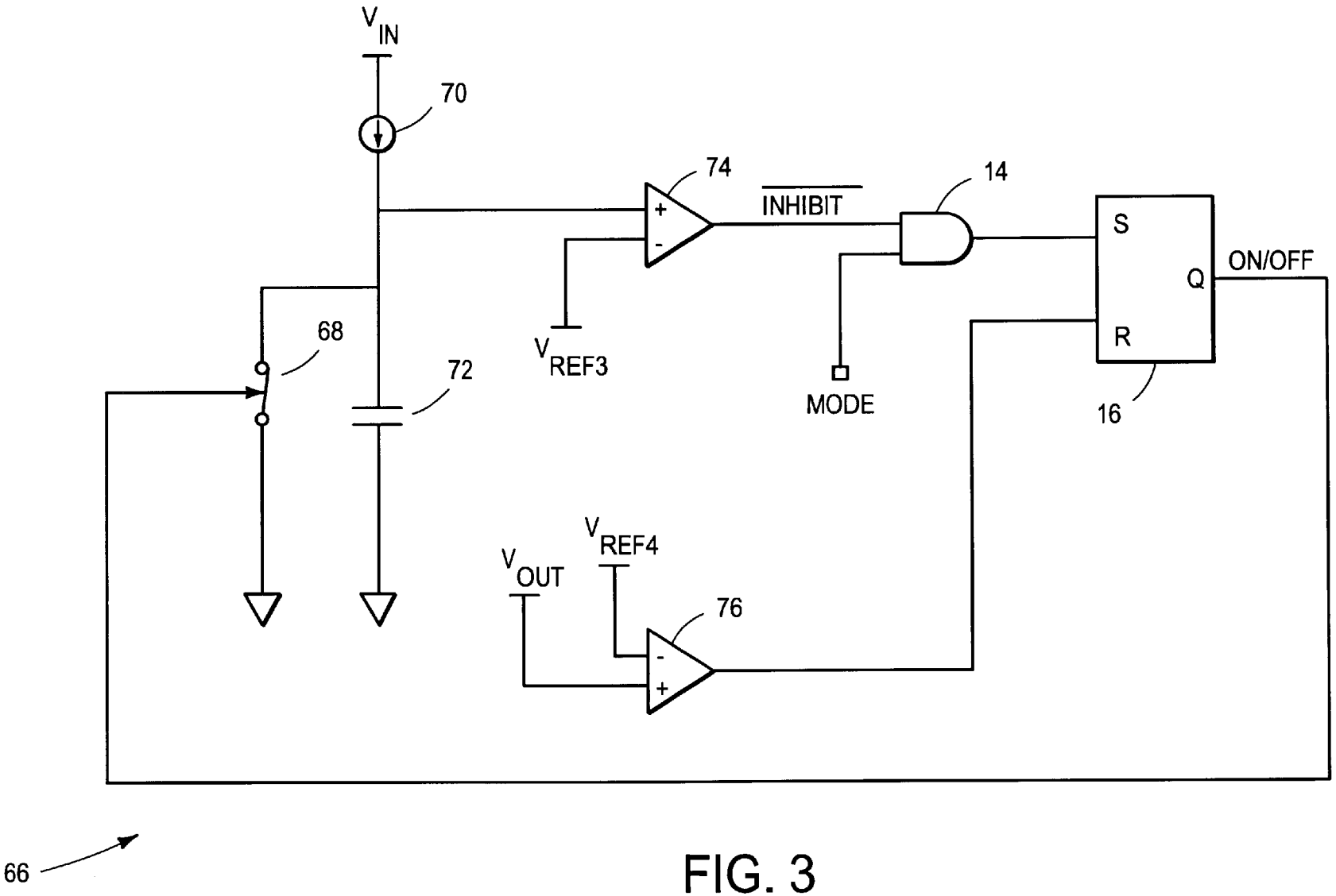
FIG. 3 is a block diagram of a timing circuit optionally used by the voltage regulator of FIG. 1.

FIG. 3 illustrates a timing circuit 66, employed to set a predetermined charge time, $T_{charge}$, while in the standby mode. A first conductor of switch 68 is coupled to the non-inverting input of comparator 74, a first conductor of current source 70 and a first conductor of capacitor 72. Second conductors of switch 68 and capacitor 72 are coupled to a second supply potential, for example, ground potential. A first conductor of current source 70 is coupled to terminal $V_{cc}$. The inverting input to comparator 74 is coupled to reference $V_{ref3}$. The output of comparator 74 is coupled to provide signal $\overline{\text{INHIBIT}}$ to a first input of AND gate 14. A second input of AND gate 14 is coupled to receive signal MODE. The non-inverting input to comparator 76 is coupled to terminal $V_{out}$ and the inverting input to comparator 76 is coupled to $V_{ref4}$. The output of comparator 76 is coupled to the reset input, R, of SR flip flop 16. The Q output of flip flop 16 establishes signal ON/OFF, which controls switch 68.

In operation, timer circuit 66 provides a predetermined charge time, $T_{charge}$, which is used by regulator 10 to determine the length of time that the charging phase is active during the standby mode of operation. The charging phase during a standby mode, for example, is shown in FIG. 2 to be between times 52 and 56. Signal ON/OFF is at a logic high during a non-charging phase of the standby mode. The amount of time, $T_{charge}$, between time 52 and time 56 is determined by timing circuit 66. At time 44, signal ON/OFF is at a logic low level, denoting normal mode. Switch 68 is disabled, allowing capacitor 72 to charge, due to the current from current source 70. The output of comparator 76 is at a logic high level, since $V_{out}$ exceeds $V_{ref4}$. Once the voltage across capacitor 72 exceeds $V_{ref3}$, the output of comparator 74 de-asserts signal $\overline{\text{INHIBIT}}$ to a logic high level. At time 48, signal MODE is asserted to a logic high level by current sense comparator 18. The output of AND gate 14 asserts to a logic high level, which sets SR flip flop 16. The Q output of SR flip flop 16 asserts signal ON/OFF to a logic high level, which activates switch 68, shorting capacitor 72 to ground potential. Since the non-inverting input of comparator 74 is at ground potential, signal $\overline{\text{INHIBIT}}$ is asserted to a logic low level. The voltage at terminal $V_{out}$ falls below $V_{ref4}$, which causes the output of comparator 76 to transition from a logic high to a logic low level, resetting SR flip flop 16 and de-asserting signal ON/OFF to a logic low level. De-asserting signal ON/OFF to a logic low level activates the charging phase of regulator 10 during the standby mode. Signal ON/OFF opens switch 68, allowing a voltage to develop across capacitor 72 according to the current supplied by current source 70. Meanwhile, current $I_{in}$ increases above current $I_{thresh}$, which asserts signal MODE. Once an amount of time, $T_{charge}$, transpires, the voltage across capacitor 72 exceeds $V_{ref3}$, causing the output of comparator 74 to transition to a logic high level, de-asserting signal $\overline{\text{INHIBIT}}$ to a logic high level and setting SR flip flop 16, since signal MODE is asserted high. The ON/OFF signal is then asserted to a logic high level, which ends the charging phase. It can be seen, therefore, that timing circuit 66 implements another method to control the amount of charge time required by regulator 10 during a charging phase of standby mode. Controlling the charge time during standby mode performs a reduced function voltage regulation, allowing coarse voltage regulation during standby mode at substantially reduced quiescent current levels. In general, a timer circuit can also be implemented which measures an amount of time between the beginning of the standby mode and the start of a charging phase as shown at times 48 and 52, respectively, obviating the need for comparator 76.

In summary, a voltage regulator is presented, which allows detection of a standby mode, indicating low current operation. Once the standby mode is detected, a low quiescent current mode is established for the regulator, which diminishes the amount of quiescent current required by the regulator by approximately two orders of magnitude, for example. During the standby mode, the regulator establishes charging cycles to maintain the output voltage at a coarsely regulated potential. Once the standby mode is terminated, normal regulation resumes and the voltage regulator provides voltage regulation to a finely regulated potential.

What is claimed is:

1. A multi-mode regulator operating in normal and standby modes to regulate an output signal, comprising:

a regulator operative in the standby mode to regulate between first and second output levels, the regulator comprising, (a) a detector coupled to receive a drive signal indicative of an output drive level and coupled to provide a deactivation signal when the drive signal is above a predetermined threshold, wherein the detector further comprises:

a summer coupled to receive the drive signal and a reference level indicative of the predetermined threshold; and a current sense amplifier having a first input coupled to receive the input signal and a second input coupled to receive an output of the summer, and (b) an activation circuit coupled to receive the deactivation signal and coupled to deactivate a first supply potential after the output signal reaches the second output level.

2. The multi-mode regulator of claim 1, wherein the activation circuit comprises a hysteretic comparator coupled to receive the output signal and coupled to deactivate the first supply potential after the output signal reaches the second output level.

3. The multi-mode regulator of claim 1, wherein the activation circuit comprises a timer circuit coupled to receive the output signal and coupled to provide a timer signal, wherein the timer signal deactivates the first supply potential.

4. The multi-mode regulator of claim 3, wherein the timer circuit comprises:

a capacitor having a first conductor coupled to provide the timer signal at a first node and a second conductor coupled to a second supply potential; and a switch having a first conductor coupled to the first node and a second conductor coupled to the second supply potential, wherein the switch operates to reset the timer signal.

5. A method of operating a voltage regulator to provide a first regulated signal during a first output drive level and a second regulated signal during a second output drive level, the method comprising:

providing a feedback signal indicative of the first regulated signal during the first output drive level;

regulating the first regulated signal to substantially equal a first reference level;

detecting the second output drive level; and regulating the second regulated signal substantially between the first reference level and a second reference level, wherein regulating the second regulated signal further comprises:

monitoring the second regulated signal;

engaging a charging circuit when the second regulated signal reaches the second reference level;

engaging a timer circuit; and disengaging the charging circuit when a timing signal from the timer circuit becomes active.

* * * * *